US009260852B2

(12) United States Patent
Wu et al.

(10) Patent No.: US 9,260,852 B2
(45) Date of Patent: Feb. 16, 2016

(54) SPIRAL GUIDING DRAIN STRUCTURE

(71) Applicant: Globe Union Industrial Corp., Taichung (TW)

(72) Inventors: Mingchia Wu, Taichung (TW); Chungyu Kuo, Taichung (TW); Tsungyi Lo, Taichung (TW); Chuwan Hong, Taichung (TW)

(73) Assignee: Global Union Industrial Corp., Taichung (TW)

( * ) Notice: Subject to any disclaimer, the term of this patent is extended or adjusted under 35 U.S.C. 154(b) by 228 days.

(21) Appl. No.: 13/927,166

(22) Filed: Jun. 26, 2013

(65) Prior Publication Data

US 2014/0130246 A1 May 15, 2014

(30) Foreign Application Priority Data

Nov. 13, 2012 (CN) ..... 2012 2 0596860 U

(51) Int. Cl.
*E03D 11/13* (2006.01)
*E03D 11/02* (2006.01)
*E03D 11/08* (2006.01)

(52) U.S. Cl.
CPC ..... *E03D 11/13* (2013.01); *E03D 11/02* (2013.01); *E03D 11/08* (2013.01); *E03D 2201/40* (2013.01)

(58) Field of Classification Search
CPC ..... E03D 11/02; E03D 11/08; E03D 11/13; E03D 2201/40
USPC ..... 4/420, 421
See application file for complete search history.

(56) References Cited

U.S. PATENT DOCUMENTS

| | | | | | |
|---|---|---|---|---|---|
| 271,557 | A * | 1/1883 | Welch et al. | ..... | 4/420 |
| 962,240 | A * | 6/1910 | Neal | ..... | 4/591 |
| 1,119,812 | A * | 12/1914 | Deignan et al. | ..... | 4/422 |
| 1,155,661 | A * | 10/1915 | Kelly | ..... | 4/422 |
| 3,411,162 | A * | 11/1968 | Palmer | ..... | 4/420 |
| 3,601,820 | A * | 8/1971 | Sargent et al. | ..... | 4/435 |
| 5,715,544 | A * | 2/1998 | Huffman et al. | ..... | 4/420 |
| 2003/0140406 | A1 * | 7/2003 | Miwa et al. | ..... | 4/420 |
| 2004/0040080 | A1 * | 3/2004 | Prokopenko et al. | ..... | 4/420 |
| 2007/0000040 | A1 * | 1/2007 | Pavek | ..... | 4/420 |
| 2008/0276361 | A1 * | 11/2008 | Mueller et al. | ..... | 4/420 |
| 2012/0210505 | A1 * | 8/2012 | Pearson | ..... | 4/420 |

FOREIGN PATENT DOCUMENTS

| | | | |
|---|---|---|---|
| CN | 201502098 | U | 6/2010 |
| TW | M245231 | U | 10/2004 |
| TW | M396294 | U | 1/2011 |

* cited by examiner

*Primary Examiner* — J. Casimer Jacyna
(74) *Attorney, Agent, or Firm* — Alan D. Kamrath; Kamrath IP Lawfirm, P.A.

(57) ABSTRACT

A spiral guiding drain structure is disposed on a toilet and includes a hidden segment and an open segment connecting with the hidden segment. The hidden segment passes through the toilet and has an inlet end leaving away from the open segment. The open segment is defined on an inner wall of the toilet and spirally surrounds the inner wall downward, a length of the open segment is at least ¾ circumference of the inner wall of the toilet, and the toilet includes a fence portion extending outwardly from a bottom rim of the open segment adjacent to an opening, and a height of the fence portion changes when an extending distance of the open segment from the hidden segment increases so that water flows out of the open segment, thus flushing the inner wall of the toilet.

9 Claims, 4 Drawing Sheets

SPIRAL GUIDING DRAIN STRUCTURE

FIELD OF THE INVENTION

The present invention relates to a spiral guiding drain structure.

BACKGROUND OF THE INVENTION

TW Pat. No. M396294 discloses that a flush toilet structure contains a water feeding pipe surrounding an inner wall of the toilet, and the water feeding pipe has three jet orifices defined on the water feeding pipe so that a jet range of a respective one of the three jet orifices is 120 degrees, thus flushing an inner wall of the toilet. However, two diameters and two heights of a front end and a rear end of the water feeding are equal, hence the three jet orifices cannot flush the toilet evenly.

TW Pat. No. M245231 discloses that a flush toilet contains a water separating plate fixed on a flushing orifice of the flush toilet so as to flow water from two sides of the flushing orifice, and two projections extend from two sides of the water separating plate so as to guide water to flush an inner wall of the toilet in 180-degree range.

CN Pat. No. 201502098U discloses that a flush toilet contains a watering orifice defined thereon and a guiding face spirally surrounding an inner wall of the toilet so as to flow water out of the watering orifice downwardly, thus increasing flushing effect.

Nevertheless, if no any limited guiding structure is defined in the toilet, water cannot generate continuous pushing kinetic energy to flush the inner wall of the toilet effectively.

The present invention has arisen to mitigate and/or obviate the afore-described disadvantages.

SUMMARY OF THE INVENTION

The primary object of the present invention is to provide a spiral guiding drain structure which is capable of overcoming the shortcomings of the conventional spiral guiding drain structure.

To obtain the above objectives, a spiral guiding drain structure is disposed on a toilet and comprises a hidden segment and an open segment connecting with the hidden segment, the hidden segment passing through the toilet and having an inlet end leaving away from the open segment, wherein the open segment is defined on an inner wall of the toilet and spirally surrounds the inner wall downward, a length of the open segment is at least ¾ circumference of an inner wall of the toilet, and the toilet includes a fence portion extending outwardly from a bottom rim of the open segment adjacent to an opening, and a height of the fence portion changes when an extending distance of the open segment from the hidden segment increases so that water flows out of the open segment, thus flushing the inner wall of the toilet.

Preferably, the open segment has a first section connected with the hidden segment, a second section coupled with the first section, a third section connected with the second section, and a fourth section coupled with the third section, wherein a height of the fence portion changes with the extending distance of the open segment from the hidden segment increases, so a part of the fence portion adjacent to the first section has a biggest height, and a height of the third section is higher than the second section and decreases from the third section to the fourth section.

Preferably, a height of the fence portion which corresponds to the first section is 4-6 mm, a height of the fence portion which corresponds to the second section is 2-4 mm, a height of the fence portion which corresponds to the third section is 3-5 mm, and a height of the fence portion which corresponds to the fourth section is 0-1 mm.

Preferably, a width of the open segment decreases when the extending distance of the open segment from the hidden segment increases.

Preferably, a width of the first section is 24-30 mm, a width of the second section is 24-16 mm, a width of the third section is 11-16 mm; and a width of the fourth section is 7-11 mm.

Preferably, a height difference between a front side and a rear side of the open segment is 22-36 mm.

Preferably, a height difference between an upstream end and a downstream end of the first segment is 8-12 mm; a height difference between an upstream end and a downstream end of the second section is 7-11 mm; a height difference between an upstream end and a downstream end of the third section is 4-8 mm; and a height difference between an upstream end and a downstream end of the fourth section is 3-5 mm.

Preferably, a height of one side of the bottom surface of the open segment which leaves away from the fence portion is higher, and a height of another side of the bottom surface of the open segment which is adjacent to the fence portion is lower.

Preferably, a width of the open segment decreases when an extending distance of the spiral guiding drain structure from the hidden segment increases.

Preferably, a width of the open segment adjacent to the hidden segment is 24-30 mm, and one end of the open segment leaving away from the hidden segment is 7-11 mm.

Preferably, a height difference between a front side and a rear side of the open segment is 22-36 mm.

Preferably, an extending shape of the hidden segment is straight, and the hidden segment extends along a tangential direction of the open segment.

Preferably, an angle θ between the hidden segment and the toilet is 25 to 30 degrees.

Preferably, this embodiment, the angle θ between the hidden segment and the toilet is 27.5 degrees.

DETAILED DESCRIPTION OF THE PREFERRED EMBODIMENTS

Figure 1:
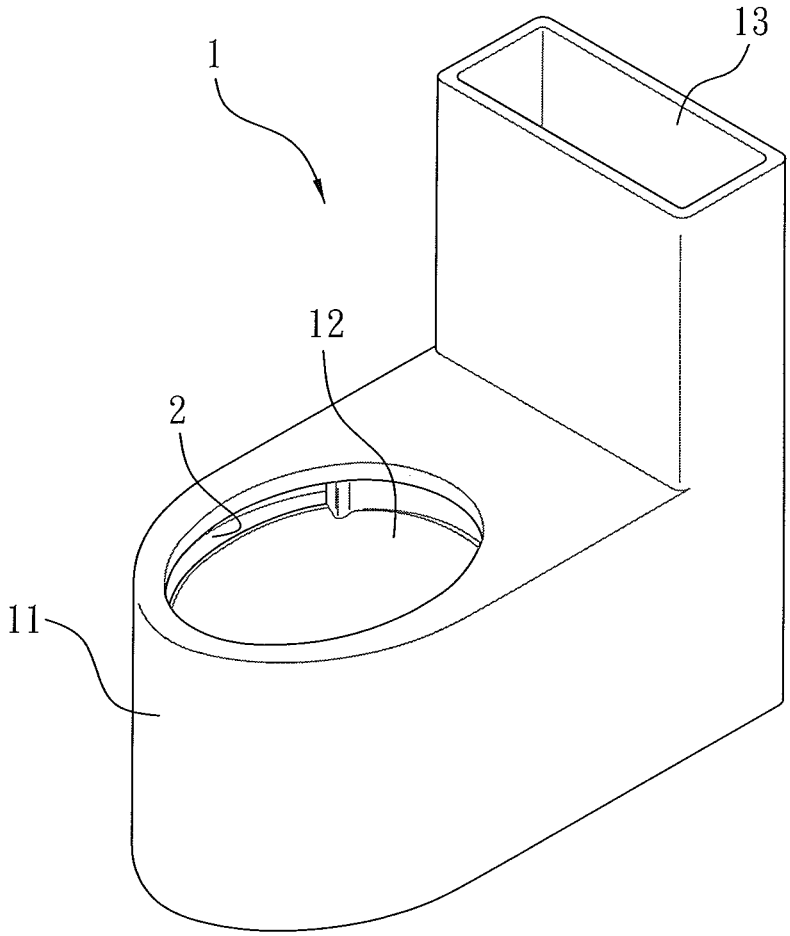
FIG. 1 is a perspective view showing the assembly of a spiral guiding drain structure according to a preferred embodiment of the present invention.
Figure 2:
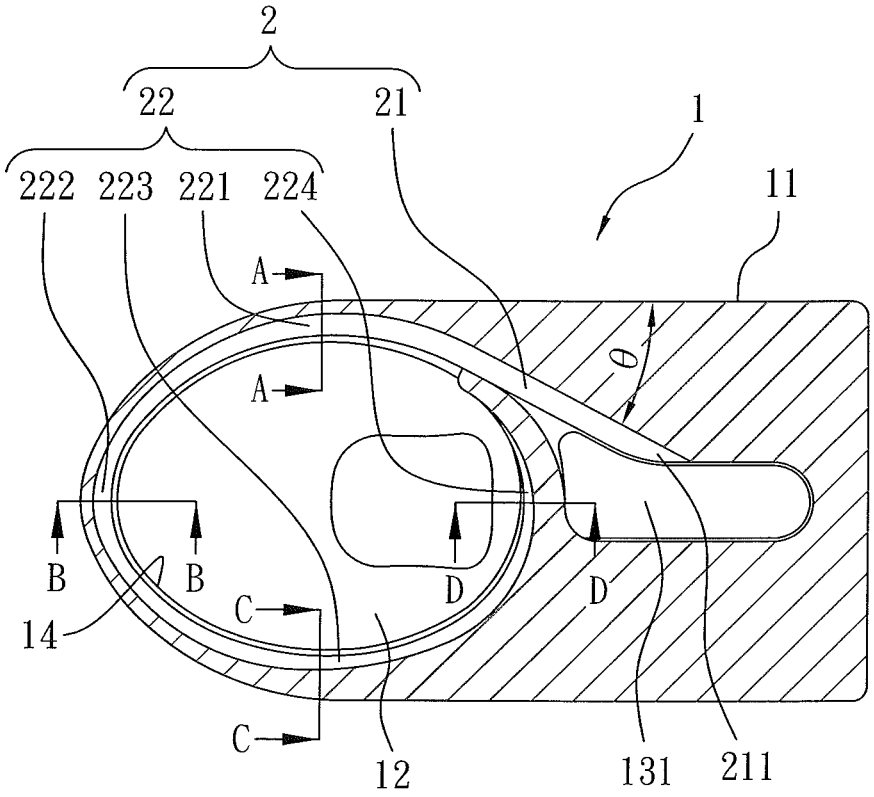
FIG. 2 is a cross sectional view showing the operation of the spiral guiding drains structure according to the preferred embodiment of the present invention.
Figure 3:
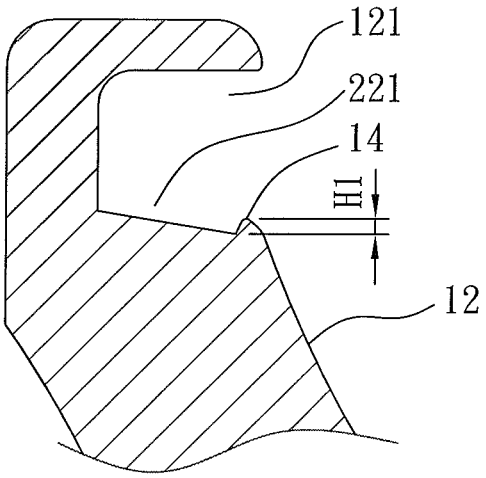
FIG. 3 is a cross sectional view taken along the line A-A of FIG. 2.
Figure 4:
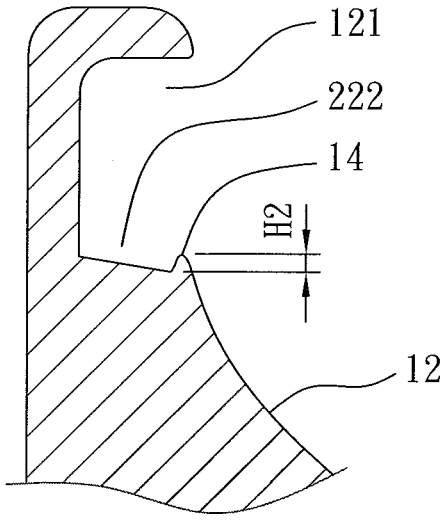
FIG. 4 is a cross sectional view taken along the line B-B of FIG. 2.
Figure 5:
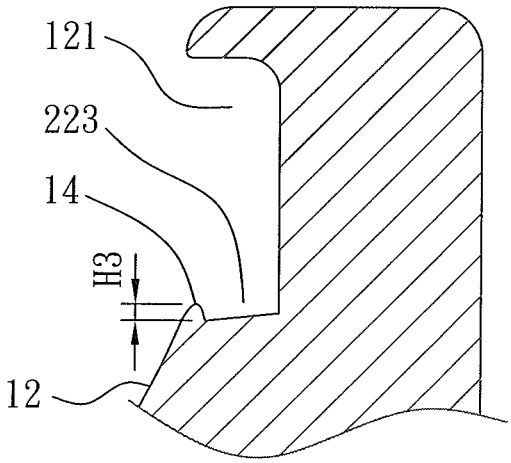
FIG. 5 is a cross sectional view taken along the line C-C of FIG. 2.
Figure 6:
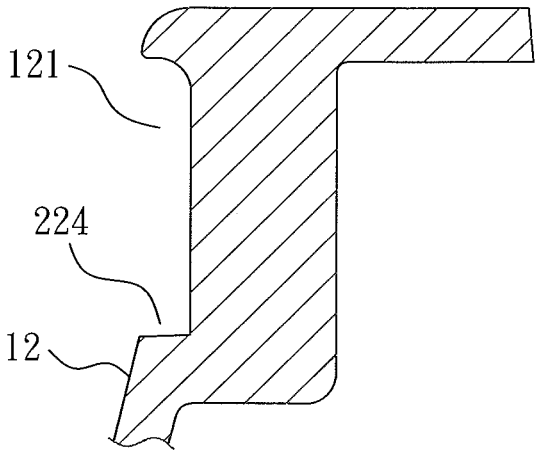
FIG. 6 is a cross sectional view taken along the line D-D of FIG. 2.

FIG. 1 is a perspective view showing the assembly of a spiral guiding drain structure according to a preferred embodiment of the present invention. FIG. 2 is a cross sectional view showing the operation of the spiral guiding drains structure according to the preferred embodiment of the present invention. FIG. 3 is a cross sectional view taken along the line A-A of FIG. 2. FIG. 4 is a cross sectional view taken along the line B-B of FIG. 2. FIG. 5 is a cross sectional view taken along the line C-C of FIG. 2. FIG. 6 is a cross sectional view taken along the line D-D of FIG. 2.

Referring further to FIGS. 1 and 2, a spiral guiding drain structure 2 according to a preferred embodiment of the present invention is disposed on a toilet 1, and the toilet 1 contains a base 11, the base 11 has a basin-shaped inner wall 12 defined therein and a water tank 13 formed on a rear side thereof.

The spiral guiding drain structure 2 includes a hidden segment 21 and an open segment 22 connecting with the hidden segment 21, and the hidden segment 21 passes through the toilet 1 and has an inlet end 211 leaving away from the open segment 22 and communicating with a bottom end 131 of the water tank 13.

The open segment 22 is defined on the basin-shaped inner wall 12 of the toilet 1 and spirally surrounds the basin-shaped inner wall 12 downward. A length of the open segment 22 is at least ¾ circumference of an inner wall 12 of the toilet 1. In this embodiment, a length of the open segment 22 which spirally surrounds the basin-shaped inner wall 12 downward is equal to a perimeter of the basin-shaped inner wall 12.

The toilet 1 includes a fence portion 14 extending outwardly from a bottom rim of the open segment 22 adjacent to an opening 121, and a height of the fence portion 14 changes with an extending distance of the open segment 22 so that water flows out of the open segment 22, thus flushing the basin-shaped inner wall 12.

As shown in FIG. 2, the basin-shaped inner wall 12 is oval and two sides of the basin-shaped inner wall 12 are symmetrical. FIGS. 3 and 6 show four 90-degrees cross sectional views of a central point of the basin-shaped inner wall 12.

Referring further to FIGS. 3 and 6, the open segment 22 has a first section 221 connected with the hidden segment 21, a second section 222 coupled with the first section 221, a third section 223 connected with the second section 222, and a fourth section 224 coupled with the third section 223. A height of the fence portion 14 changes when the extending distance of the open segment 22 from the hidden segment 21 increases, for example, a part of the fence portion 14 adjacent to the first section 221 has a biggest height, and a height of the third section 223 is higher than the second section 222 and decreases from the third section 223 to the fourth section 224. In this embodiment, the length of the open segment 22 is equal to the circumference of the inner wall 12, so four lengths of the first section 221, the second section 222, the third section 223, and the fourth section 224 are ¼ of the circumference of the inner wall 12. Also, a height of the fence portion 14 which corresponds to the first section 221 is 4-6 mm. A height of the fence portion 14 which corresponds to the second section 222 is 2-4 mm. A height of the fence portion 14 which corresponds to the third section 222 is 3-5 mm, and a height of the fence portion 14 which corresponds to the fourth section 224 is 0-1 mm.

Four positions of the lines A-A, B-B, C-C, and D-D of FIG. 2 are four central positions of the first section 221, the second section 222, the third section 223, and the fourth section 224. In this embodiment, a first height H1 of the fence portion 14 of the line A-A of FIG. 3 is 5 mm. A second height H2 of the fence portion 14 of the line B-B of FIG. 4 is 3 mm. A third height H3 of the fence portion 14 of the line C-C of FIG. 5 is 4 mm. A fourth height of the fence portion 14 of the line D-D of FIG. 6 is 0 mm.

A width of the open segment 22 decreases when the extending distance of the open segment 22 from the hidden segment 21 increases. In this embodiment, a width of the first section 221 is 24-30 mm; a width of the second section 222 is 24-16 mm; a width of the third section 223 is 11-16 mm; and a width of the fourth section 223 is 7-11 mm. A height, of one side of the bottom surface of the open segment 22 which leaves away from the fence portion 14 is higher, and a height of another side of the bottom surface of the open segment 22 which is adjacent to the fence portion 14 is lower.

A height difference between a front side and a rear side of the open segment 22 is 22-36 mm. In this embodiment, a height difference between an upstream end and a downstream end of the first segment 221 is 8-12 mm; a height difference between an upstream end and a downstream end of the second section 222 is 7-11 mm; a height difference between an upstream end and a downstream end of the third section 223 is 4-8 mm; and a height difference between an upstream end and a downstream end of the fourth section 224 is 3-5 mm. An extending shape of the hidden segment 21 is straight, and the hidden segment 21 extends along a tangential direction of the open segment 22, an angle θ between the hidden segment 21 and the toilet 1 is 25 to 30 degrees. In this embodiment, the angle θ is 27.5 degrees.

Because the open segment 22 of the spiral guiding drain structure 2 spirally surrounds the basin-shaped inner wall 12 downward, the fence portion 14 extends outwardly from the bottom rim of the open segment 22 adjacent to the opening 121, the height of the fence portion 14 changes when the extending distance of the open segment 22 from the hidden segment 21 increased, and the width of the open segment 22 decreases when the extending distance of the open segment 22 from the hidden segment 21 increases, hence a limited guiding structure is formed so that after the water flows out of the water tank 13, it still keeps pushing kinetic energy so that the water flows to an ending point of the open segment 22 from a starting point of the open segment 22, and in the open segment 22, the water flows out of the inner wall 12 via the fence portion 14, thus having a 360-degree flushing effect.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A spiral guiding drain structure being disposed on a toilet and comprising a hidden segment and an open segment connecting with the hidden segment, the hidden segment passing through the toilet and having an inlet end leaving away from the open segment, wherein the open segment is defined on an inner wall of the toilet and spirally surrounds the inner wall downward, a length of the open segment is around a circumference of an inner wall of the toilet, and the toilet includes a fence portion extending outwardly from a bottom rim of the open segment adjacent to an opening, and a height of the fence portion changes when an extending distance of the open segment from the hidden segment increases, wherein the open segment has a first section connected with the hidden segment, and a part of the fence portion adjacent to the first section has a biggest height, such that that water flows out of the open segment, thus flushing the inner wall of the toilet;

wherein a width of the open segment decreases when the extending distance of the open segment from the hidden segment increases;

wherein a width of the open segment decreases when an extending distance of the spiral guiding drain structure from the hidden segment increases;

wherein the open segment also has a second section coupled with the first section, a third section connected with the second section, and a fourth section coupled with the third section, and a height of the third section is higher than the second section and decreases from the third section to the fourth section, a length of each of the first section, the second section, the third section, and fourth section is ¼ circumference of the inner wall of the toilet;

wherein the inner wall of the toilet is oval and two sides of the inner wall of the toilet are symmetrical, and a connection portion of the second section and the third section has a curved angle wherein a height of one side of the bottom surface of the open segment which is away from the fence portion is higher, and a height of another side of the bottom surface of the open segment which is adjacent to the fence portion is lower, the bottom surface of the open segment tilts inwardly, and a top surface of the open segment is flat.

2. The spiral guiding drain structure as claimed in claim 1, wherein a height of the fence portion which corresponds to the first section is 4-6 mm, a height of the fence portion which corresponds to the second section is 2-4 mm, a height of the fence portion which corresponds to the third section is 3-5 mm, and a height of the fence portion which corresponds to the fourth section is 0-1 mm.

3. The spiral guiding drain structure as claimed in claim 1, wherein a width of the first section is 24-30 mm, a width of the second section is 24-16 mm, a width of the third section is 11-16 mm; and a width of the fourth section is 7-11 mm.

4. The spiral guiding drain structure as claimed in claim 1, wherein a height difference between a front side and a rear side of the open segment is 22-36 mm.

5. The spiral guiding drain structure as claimed in claim 4, wherein a height difference between an upstream end and a downstream end of the first segment is 8-12 mm; a height difference between an upstream end and a downstream end of the second section is 7-11 mm; a height difference between an upstream end and a downstream end of the third section is 4-8 mm; and a height difference between an upstream end and a downstream end of the fourth section is 3-5 mm.

6. The spiral guiding drain structure as claimed in claim 1, wherein a width of the open segment adjacent to the hidden segment is 24-30 mm, and one end of the open segment leaving away from the hidden segment is 7-11 mm.

7. The spiral guiding drain structure as claimed in claim 1, wherein an extending shape of the hidden segment is straight, and the hidden segment extends along a tangential direction of the open segment.

8. The spiral guiding drain structure as claimed in claim 7, wherein an angle θ between the hidden segment and the toilet is 25 to 30 degrees.

9. The spiral guiding drain structure as claimed in claim 8, wherein this embodiment, the angle θ between the hidden segment and the toilet is 27.5 degrees.

* * * * *